US007570221B2

(12) United States Patent
May et al.

(10) Patent No.: US 7,570,221 B2
(45) Date of Patent: Aug. 4, 2009

(54) REDUCED BEAMWIDTH ANTENNA

(75) Inventors: Jack May, Foster City, CA (US); Stephen D. Stearns, Saratoga, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 125 days.

(21) Appl. No.: 11/861,893

(22) Filed: Sep. 26, 2007 (Under 37 CFR 1.47)

(65) Prior Publication Data

US 2009/0079644 A1 Mar. 26, 2009

(51) Int. Cl.
*H01Q 19/06* (2006.01)
*H01Q 15/02* (2006.01)

(52) U.S. Cl. ..... 343/753; 343/909

(58) Field of Classification Search ..... 343/753, 343/754, 755, 905, 909
See application file for complete search history.

(56) References Cited

U.S. PATENT DOCUMENTS 5,933,120 A * 8/1999 Manasson et al. ..... 343/788
6,280,960 B1 * 8/2001 Carr ..... 435/7.2
6,958,729 B1 10/2005 Metz
7,135,917 B2 11/2006 Kozyrev et al.
7,177,513 B2 2/2007 Povinelli et al.
7,218,285 B2 5/2007 Davis et al.
2005/0225492 A1 10/2005 Metz

FOREIGN PATENT DOCUMENTS

CN 101162800 A 10/2006
GB 2382230 A 5/2002

OTHER PUBLICATIONS

Amitay, et al.: "*The Analysis of Circular Waveguide Phased Arrays*"; pp. 1903-1932.
Borgiotti: "*Modal Analysis of Periodic Planar Phased Arrays of Apertures*"; Proceedings of the IEEE, vol. 56, No. 11, Nov. 1968, pp. 1881-1892.
Chen: "*Diffraction of Electromagnetic Waves by a Conducting Screen Perforated Periodically with Circular Holes*"; IEEE Transactions on Microwave Theory and Techniques, vol. MTT-19, No. 5, May 1971, pp. 475-481.
Chen: "*Transmission Through a Conducting Screen Perforated Periodically with Apertures*"; IEEE Transactions on Microwave Theory and Techniques, vol. MTT-18, No. 9, Sep. 1970, pp. 627-632.
Eleftheriades: "*Planar Negative Refractive Index Media Using Periodically L-C Loaded Transmission Lines*"; IEEE Transactions on Microwave Theory and Techniques, vol. 50, No. 12, Dec. 2002, pp. 2702-2712.

(Continued)

*Primary Examiner*—Shih-Chao Chen
(74) *Attorney, Agent, or Firm*—Tarolli, Sundheim, Covell & Tummino LLP

(57) ABSTRACT

Systems and methods for reducing the beamwidth of an antenna system are provided. An evanescent field generator generates an evanescent field representing a far field radio frequency (RF) signal received at the antenna system. A negative refractive index lens assembly focuses the evanescent field onto a focal plane. An RF detector assembly located in the focal plane detects the amplified evanescent field.

11 Claims, 3 Drawing Sheets

OTHER PUBLICATIONS

Engheta: "*A Positive Future for Double-Negative Metamaterials*"; IEEE Transactions on Microwave Theory and Techniques, vol. 53, No. 4, Apr. 2005, pp. 1535-1556.

Pendry: "*Reversing Light with Negative Refraction*"; Physics Today, Jun. 2004, pp. 37-43.

Ramakrishna: "*Physics of Negative Refractive Index Materials*"; Institutes of Physics Publishing, Reports on Progress in Physics, Rep. Prog. Phys. 68 (2005) 449-521.

Caloz, et al.: "*Metamaterials for High-Frequency Electronics*"; Proceedings of the IEEE, vol. 93, No. 10, Oct. 2005, pp. 1744-1752.

Wongkasem, et al.: "*Novel Broadband Terahertz Negative Refractive Index Metamaterials: Analysis and Experiment*"; Progress in Electromagnetics Research, PIER 64, pp. 205-208, 2006.

Commonly assigned co-pending patent application entitled: "Imaging System Having Enhanced Resolution", Sep. 26, 2007.

I Dvir et al.: "*On The Generation of Broad-Band Beams for a Nondispersive Time-Signal Transmission*"; IEEE Trans. On Antennas and Propogation, vol. 46, No. 12, Dec. 1998 pp. 1774-1781.

A Grbic et al.: "*Growing Evanescent Waves in Negative-Refractive-Index Transmission-Line Media*"; Applied Physics Letters, vol. 82, No. 12, Mar. 2003 pp. 1815-1817.

G V Eleftheriades: "*Negative-Refractive-Index Metamaterials using Loaded Transmission Lines and Enabling RF Devices*"; Semiconductor Device Research Symposium, 2003 International Dec. 10-12, 2003 pp. 528-529.

UK Search Report for corresponding GB0817644.8 completed Nov. 24, 2008 by Mr. John Watt of the UKPTO.

* cited by examiner

REDUCED BEAMWIDTH ANTENNA

RELATED APPLICATIONS

This application is related to the following commonly assigned co-pending patent application entitled: "IMAGING SYSTEM HAVING ENHANCED RESOLUTION," Ser. No. 11/861,862, of which is being filed contemporaneously herewith and is incorporated herein by reference.

TECHNICAL FIELD

The present invention relates generally to communications systems, and more particularly to an antenna having reduced beamwidth.

BACKGROUND OF THE INVENTION

One significant indication of the spatial resolution of an antenna is the antenna beamwidth. The half power beamwidth is defined as the angular separation between the half power points on an antenna radiation pattern, where the gain is one half the maximum value. For a reflector antenna, the half power beamwidth, $\alpha$, can be expressed as:

$$\alpha = \frac{k\lambda}{D} \qquad \text{Eq. 1}$$

where $\lambda$ is the wavelength of the received signal, k is a factor that depends on the shape of the reflector and the method of illumination, and D is the diameter of the antenna.

As seen in Equation 1, the half power beamwidth decreases with decreasing wavelength and/or increasing diameter. Accordingly, for an antenna designed for a given wavelength, the limiting factor on antenna performance is the antenna size. It will be appreciated, however, that there are practical limitations to the maximum size of an antenna. This is especially true in mobile communications applications, where the available space and power for an antenna is significantly limited.

SUMMARY OF THE INVENTION

In accordance with an aspect of the present invention, an antenna system having a reduced beamwidth is provided. An evanescent field generator generates an evanescent field resulting in the restoration of high spatial frequency components to a far field radio frequency (RF) signal received at the antenna system. A negative refractive index lens assembly focuses the evanescent field onto a focal plane. An RF detector assembly located in the focal plane detects the amplified evanescent field.

In accordance with another aspect of the present invention, a method is provided for detecting a far field RF signal. A far field RF signal is spatially filtered to restore high spatial frequency components to the far field RF signal to produce an evanescent field. The evanescent field is focused onto a focal plane. The focused evanescent field is detected in the focal plane.

DETAILED DESCRIPTION OF INVENTION

In accordance with an aspect of the present invention, an antenna system is provided for detecting far field radio frequency (RF) signals with a reduced beamwidth. High spatial frequencies within an RF signal tend to attenuate as they propagate over a distance, such that an RF signal detected in the far-field region of the RF signal source can be approximated as a plane wave. To restore the angular spectrum of the far field signal, specifically the high spatial frequency components lost during propagation, the received RF signal is perturbed to create a localized field having a rapid variation in field strength over distance, referred to as an evanescent field, and having a specially tailored amplitude and phase characteristic. By restoring the angular spectrum of the signal, it is possible to produce a signal that can be focused. A negative refractive index (NRI) lens can be placed in close proximity to the origin of the evanescent field to preserve the field, which is prone to exponential attenuation in positive index of refraction material. Such materials are also referred to as double negative (DNG) materials and negative index of refraction (NIR) materials. The NRI lens focuses the field into a fractional wavelength focal point representing the signal. The antenna system preserves the spatial displacement of RF sources, such that each of a plurality of far field RF sources will resolve into separate focal points in the focal plane of the lens.

Figure 1:
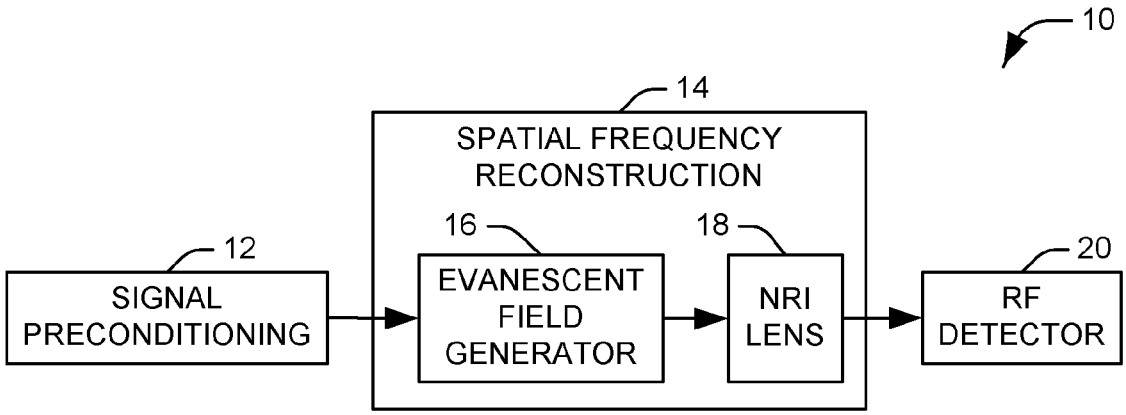
FIG. 1 illustrates an antenna system having a reduced beamwidth in accordance with an aspect of the present invention.

FIG. 1 illustrates an antenna system 10 having a reduced beamwidth for detecting far field radio frequency (RF) signals in accordance with an aspect of the present invention. The system 10 includes a signal preconditioning element 12 that collects RF energy and directs the energy onto a spatial frequency reconstruction assembly 14. In one implementation, the signal preconditioning element 12 can comprise a parabolic reflector. The spatial frequency reconstruction assembly 14 is configured to restore high spatial frequency components to one or more far field RF signals in the collected RF energy and focus the far field RF energy onto an associated focal plane.

The spatial frequency reconstruction assembly 14 comprises an evanescent field generator 16 that generates an evanescent field representing a far field (RF) signal received at the antenna system. The evanescent field generator 16 spatially samples the incoming far field RF signal according to a desired transfer function to produce an evanescent field having suitable properties for focusing at an associated negative refractive index (NRI) lens assembly 18. In one implementation, the evanescent field generator 16 comprises a metallic plate having a plurality of apertures arranged in a grid. The diameter and effective path length of each of the plurality of apertures can be varied to produce a desired complex gain in the incident far field signal. For example, the holes can be angled or coiled to increase the path length of RF signals traveling through the holes. Alternatively, an appropriate dielectric material can be used to slow the passage of the signal through the hole, producing a change in the effective path length of the signal that causes a desired shift in the phase of the signal.

The negative refractive index lens assembly 18 is positioned such that an infinitesimal gap (e.g., with a spacing of less than a wavelength) is present between the negative refractive index lens and the evanescent field generator 16 to mitigate loss in the evanescent field. The negative refractive index lens assembly 18 has an amplifying effect on the incident evanescent wave field, preserving the field across the width of the lens, as well as a focusing effect. The lens effectively sums the various perturbations in the RF field to a single focal point in a focal plane associated with the lens. The evanescent field generator 16 and the NRI lens assembly 18 can be configured to produce a focal point have a width of less than a wavelength. In one implementation, the negative refractive index lens 18 is formed from a broadband negative refractive index metamaterial formed from a plurality of discrete units of passive or active circuitry.

An RF detector 20 can be positioned within the focal plane of the NRI lens 18 to detect the focused evanescent field as an RF signal. The RF detector 20 can comprise any suitable arrangement for detecting the focused RF field energy. In an exemplary implementation, the RF detector 20 can comprise a plurality of fractional wavelength RF antennas that are capable of detecting the focused RF energy. The detected signal can then be provided to any of a variety of processing systems to extract desired data (e.g., RF source location and characteristics, information carried in the signal, etc.) from the received RF signal.

Figure 2:
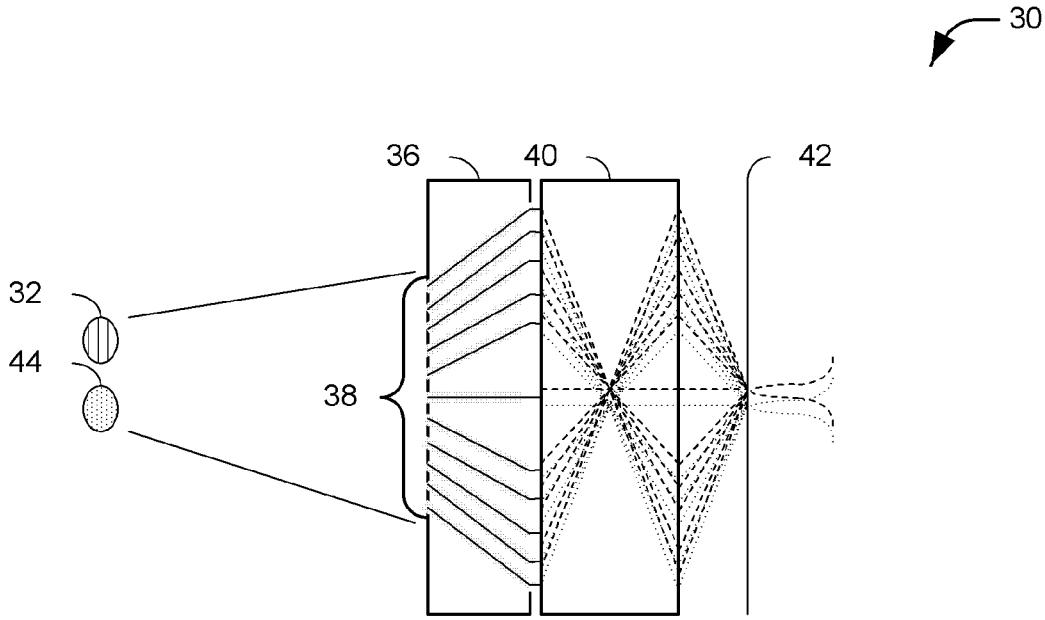
FIG. 2 illustrates a first implementation of an antenna system in accordance with an aspect of the present invention.

FIG. 2 illustrates a first implementation of an antenna system 30 in accordance with an aspect of the present invention. Energy from a far field RF source 32 is directed to an RF mask 36. The RF mask 36 spatially samples the input field to produce an evanescent field output, $h_D(x,y)$, that is the product of the input RF field, g(x,y), and a spatial transfer function, h(x,y), imposed by the mask. A desired field in the output plane can be achieved by appropriate design of an array of apertures 38 in the mask 36. The aperture array 38 can be arranged in a regular rectangular lattice spacing, with the diameter and effective path length of each aperture varied to produce a desired complex gain at the aperture. In the illustrated example, the apertures 38 can be made of short circular waveguides of slightly different diameters and lengths to obtain gain and phase control. Accordingly, the spatial variation of the evanescent field output at the mask 36 can be controlled with significant precision to generate a desired field.

For a paraxial optical system, the RF field can be conceptualized as a series of planes that are perpendicular to the optical axis, which will be defined as the z axis. Assuming a monochromatic wave propagating in the positive z direction, (i.e., $k_z>0$), the RF field incident on the mask 36 can be approximated as a time-harmonic or phasor field g(x,y) in an x-y plane transverse to the optical axis z. For the present example, only scalar diffraction is considered and field quantities are represented as complex scalars. The extension to vector diffraction and coupled electric and magnetic vector fields is straightforward for one of skill in the art. The field in the plane may be characterized by its two-dimensional angular spectrum, which is the two-dimensional Fourier transform of g(x,y) with respect to the spatial variables x and y.

$$G(f_X, f_Y) = \Im\{g\{x, y)\} = \int_{-\infty}^{\infty}\int g(x, y)\exp[-j2\pi(f_X x + f_Y y)]dxdy \quad \text{Eq. 2}$$

The input RF field at the mask 36 may be regarded to be a plane wave originating from a far field source on axis, such that the field incident on the mask, g(x, y), can be represented as unity for all values x and y, and its spectrum, $G(f_X, f_Y)$, can be denoted as $\delta(f_X)\delta(f_Y)$. In the illustrated implementation, the mask, h(x, y), is a rectangular Cartesian lattice of apertures or holes. In the following discussion, the apertures are taken to be circles of radius, a. The radius and effective path length of the apertures can be selected such that the mask produces a desired output field, $h_D(X,y)$, from the input field, g(x, y). For example, the desired output field can be a spatially white field, that is a field in which all spatial frequencies are present with roughly equal amplitude. Thus, the appropriate mask design can be determined by solving for the complex gains, $\{a_{mn}\}$, where $a_{mn}$ is the complex gain of aperture (m,n) in the rectangular lattice, in the following:

$$h_D(x, y) = \sum_{m=-\infty}^{\infty}\sum_{n=-\infty}^{\infty} a_{mn}\delta\left(\frac{x}{\Delta_X} - m\right)\delta\left(\frac{y}{\Delta_Y} - n\right) * circ\left(\sqrt{\left(\frac{x}{a}\right)^2 + \left(\frac{y}{a}\right)^2}\right) \quad \text{Eq. 3}$$

$$\text{where } circ\left(\sqrt{x^2 + y^2}\right) = \begin{cases} 1 & \sqrt{x^2 + y^2} \le 1 \\ 0 & \text{otherwise} \end{cases} \quad \text{Eq. 4}$$

Taking the Fourier transform of each side:

$$H_D(f_X, f_Y) = \sum_{m=-\infty}^{\infty}\sum_{n=-\infty}^{\infty} a_{mn}\exp[-j(m\Delta_X f_X + n\Delta_Y f_Y)\frac{J_1\left(2\pi\sqrt{(af_X)^2 + (af_Y)^2}\right)}{\sqrt{(af_X)^2 + (af_Y)^2}} \quad \text{Eq. 5}$$

where $J_p(\bullet)$ is the $p^{th}$ order Bessel function of the first kind.

The Airy term on the right side is independent of the variables of summation and can be moved to the left side:

$$\frac{H_D(f_X, f_Y)\sqrt{(af_X)^2 + (af_Y)^2}}{J_1\left(2\pi\sqrt{(af_X)^2 + (af_Y)^2}\right)} = \sum_{m=-\infty}^{\infty}\sum_{n=-\infty}^{\infty} a_{mn}\exp[-j(m\Delta_X f_X + n\Delta_Y f_Y)] \quad \text{Eq. 6}$$

The right side comprises a superposition of Hermitian orthogonal kernel functions, and each coefficient can be extracted by a generalized inner product, specifically an inverse Fourier transform. Multiplying both sides by $\exp[j(m\Delta_X f_X + n\Delta_Y f_Y)]$ and integrating gives the desired value for the complex gains of the apertures.

$$a_{mn} = \frac{1}{2\pi}\int_{-\infty}^{\infty}\int \frac{H_D(f_X, f_Y)\sqrt{(af_X)^2 + (af_Y)^2}}{J_1\left(2\pi\sqrt{(af_X)^2 + (af_Y)^2}\right)} \exp[j(m\Delta_X f_X + n\Delta_Y f_Y)]df_X df_Y \quad \text{Eq. 7}$$

An alternate approach would be to abandon exact field synthesis for field approximation under some criterion, such as a minimum $L_2$ norm (least-squares) reconstruction. Such an approach leads also to a formal closed-form solution for the optimal complex gains $\{a_{mn}\}$ for the apertures.

The output field is then provided to a negative refractive index lens 40 that preserves the evanescent field created at the mask 36 and focuses it onto a detector 42 in a focal plane. By a "negative refractive index lens," it is intended to encompass any of a number of engineered metamaterials or natural materials having both an electric permittivity and a magnetic permeability that are negative for radio frequencies. In the illustrated embodiment, the negative refractive index lens 40 is a Pendry slab lens positioned such that an infinitesimal gap exists between the mask 36 and the lens. The detector 42 can comprise a plurality of fractional wavelength RF antennas that are capable of detecting the focused RF energy.

When a plurality of antennas is used, the system becomes a beamformer, with each antenna in the detector array producing an output signal corresponding to a separate beam. For a second far field RF source 44 that is off the optical axis, for example, in the y=0 plane, the received field would have an incident field, $g_2(x, y),=\exp(f_X'x)$, and spectrum, $G(f_X, f_Y)=\delta(f_X-f_X)\delta(f_Y)$. Because the mask is multiplicative, the linear phase shift term $\exp(f_X'x)$ appears in the output field $h_{D2}(x, y)$, and the output's angular spectrum is shifted by the amount, $f_X,'$ along the $f_X$ axis. Accordingly, optical displacements are preserved by the mask operation, and the received energy from the first RF source 32 and the second RF source 44 will be represented as respective separate focal points of a fraction of a wavelength in width at the focal plane 42.

Figure 3:
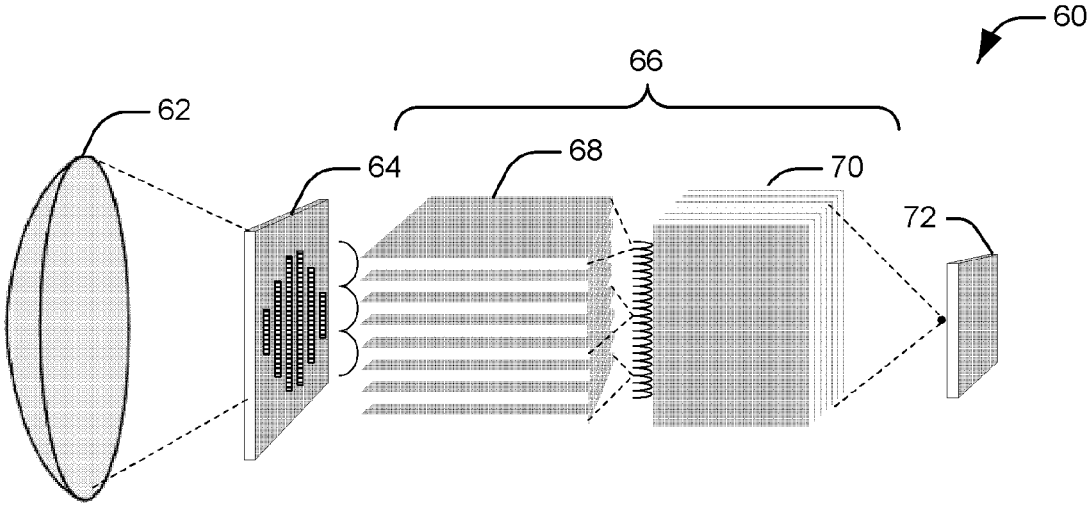
FIG. 3 illustrates a second implementation of an antenna system in accordance with an aspect of the present invention.

FIG. 3 illustrates a second implementation of an antenna system 60 in accordance with an aspect of the present invention. The system 60 includes a parabolic reflector 62 that collects RF energy and directs the RF energy onto an RF mask 64. In the illustrated implementation, the RF mask 64 comprises a sheet of material, selected to be opaque to RF radiation, having a plurality of apertures. The RF mask spatially samples the input RF field across the plurality of apertures to produce an evanescent field output. The complex gain, that is, the amplitude and applied phase shift, of the RF field at each of the plurality of apertures can be controlled by varying the diameter and effective path length of each aperture. For example, the apertures can be angled or coiled to increase their length, as well as loaded with a radio transparent dielectric material to slow the passage of the signal through the aperture. The complex gain at each aperture is selected to produce an evanescent field having a full angular spectrum to facilitate focusing at a negative refractive index lens assembly 66.

The negative refractive index lens assembly 66 comprises a first stack of active or passive NRI circuit boards 68 and a second stack of active or passive NRI circuit boards 70. The first stack of NRI circuit boards 68 comprises a plurality of planar circuit boards that implement a planar NRI metamaterial and that are aligned in a first direction to focus the RF energy into a plurality of intermediate fields. This function is similar to that of a cylindrical lens at right angles to the system axis. The intermediate fields can include fractional wavelength fields aligned along one axis. For example, if the evanescent wave is assumed to be propagating along the z-axis, the first stack of NRI circuit boards 68 can be aligned parallel to the x-z plane to focus the RF energy along the y-axis. Each of the planar circuit boards can comprise a plurality of microstrip transmission lines arranged to implement a planar NRI metamaterial. The transmission lines can include periodic active elements, for example, at junctions between transmission lines, to reduce losses in the transmission lines.

The second stack of NRI boards 70 can be aligned in a second direction (e.g., in the y-z plane) to further focus the line that lies along the y-axis into a single point in an associated focal plane. It will be appreciated that the two-stage focusing process represented by the first and second stacks of NRI boards 68 and 70 permits the use of multiple planar lens components as an alternative to a single volumetric (e.g., three-dimensional lens). One skilled in the art will appreciate that a single, three-dimensional lens assembly could be utilized as the illustrated negative refractive index assembly 66.

One or more RF antennas 72 can be positioned in the focal plane to detect the focused RF field energy. In an exemplary embodiment, a plurality of fractional wavelength antennas are positioned in the focal plane to allow for discrimination of multiple spatially separated RF sources. In this implementation, the system functions as a beamformer, with each antenna producing an output signal that corresponds to a separate beam. It will be appreciated that the RF mask 64, the first stack of NRI boards 68, and the second stack of NRI boards 70 can be positioned with infinitesimal gaps between them to mitigate attenuation in the evanescent field.

Figure 4:
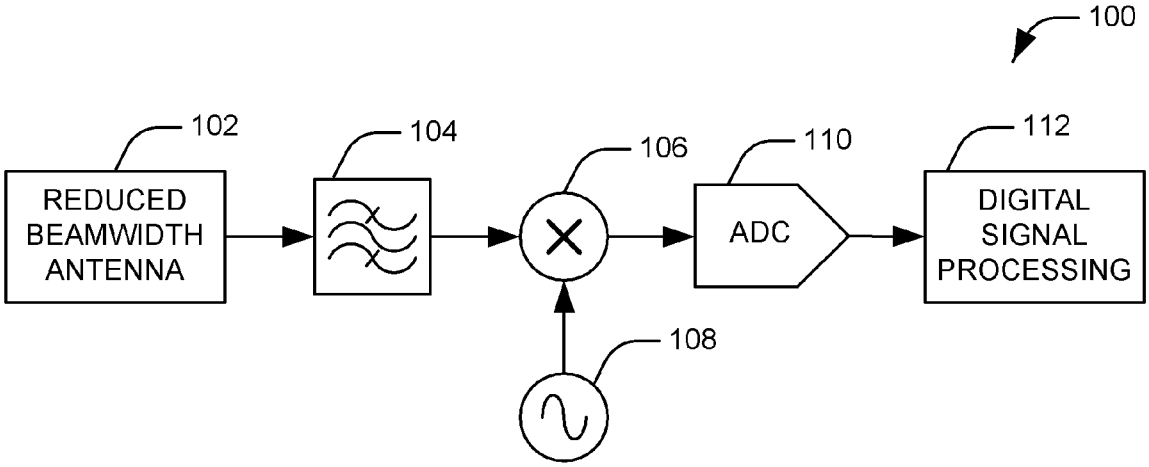
FIG. 4 illustrates an implementation of a receiver system in accordance with an aspect of the present invention.

FIG. 4 illustrates a receiver system 100 in accordance with an aspect of the present invention. The receiver system 100 comprises a reduced beamwidth antenna system 102 that detects an information-carrying far field radio frequency (RF) signals with a reduced beamwidth. The reduced beamwidth antenna system 102 restores the high spatial frequency components of the far field signal and focuses the resulting signal with a negative refractive index (NRI) lens to produce a fractional wavelength focal point representing the signal. The received far field signal is then filtered at a bandpass filter 104 and downconverted to an intermediate frequency at a multiplier 106 using an appropriate local oscillator 108. The down converted signal is then digitized at an analog to digital converter (ADC) 110 and provided to a digital signal processing component. The digital signal processing component 112 demodulates the far field RF signal to extract the information carried in the signal.

Figure 5:
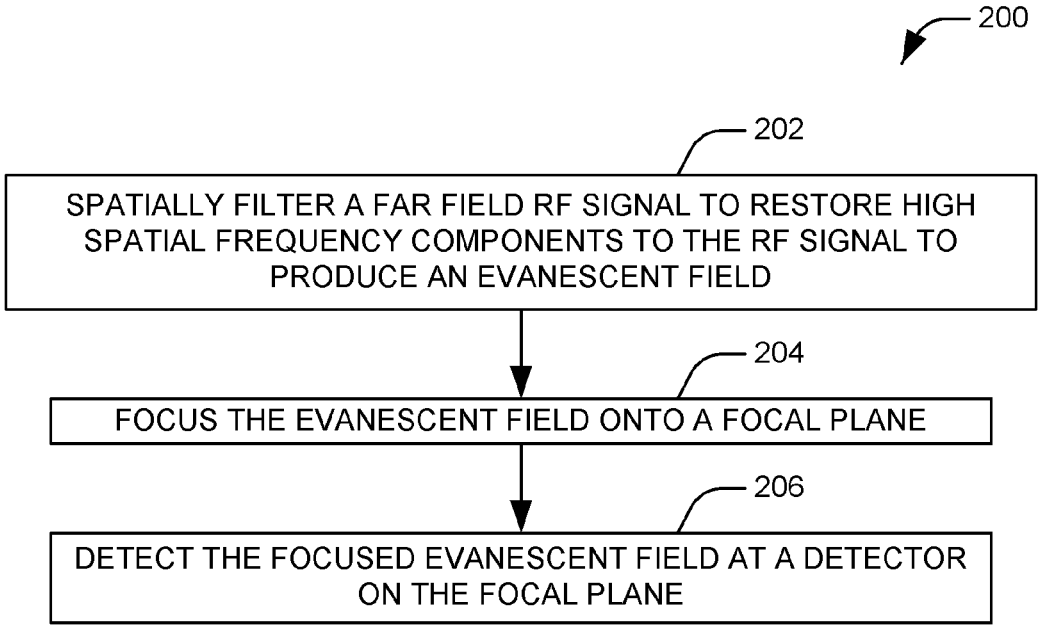
FIG. 5 illustrates a methodology for detecting a far field signal in accordance with an aspect of the present invention.

In view of the foregoing structural and functional features described above, a methodology in accordance with various aspects of the present invention will be better appreciated with reference to FIG. 5. While, for purposes of simplicity of explanation, the methodology of FIG. 5 is shown and described as executing serially, it is to be understood and appreciated that the present invention is not limited by the illustrated order, as some aspects could, in accordance with the present invention, occur in different orders and/or concurrently with other aspects from that shown and described herein. Moreover, not all illustrated features may be required to implement a methodology in accordance with an aspect the present invention.

FIG. 5 illustrates a methodology 200 for detecting a far field signal in accordance with an aspect of the present invention. At 202, a far field RF signal is spatially filtered to restore high spatial frequency components to the far field RF signal as to produce an evanescent field. For example, the evanescent field can comprise a plurality of spatially isolated samples of the RF signal having varying complex gains. For example, the RF signal can be directed to a mask having a plurality of apertures. Each of the apertures in the mask can vary in diameter and effective path length to control, respectively, the amplitude and phase of the RF field at that aperture. The evanescent field generator can be a metal mask with periodic holes. In an alternative implementation, the mask can be a dielectric plate with periodic apertures or obstacles made of a different dielectric or of metal.

At 204, the evanescent field is focused onto a focal plane. The evanescent field, generally speaking, will attenuate, leaving only a substantially uniform field in a very small distance (e.g., on the order of a wavelength). Accordingly, a lens should be placed in close proximity to the source of the evanescent field to preserve and focus the field. In an exemplary embodiment, the lens can comprise one or more lens structures formed from metamaterials engineered to have a negative refractive index for radio frequencies. The focused signal is then detected by a detector in the focal plane, such as an RF antenna, at 206.

What has been described above includes exemplary implementations of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

Having described the invention, the following is claimed:

1. An antenna system having a reduced beamwidth, comprising:

an evanescent field generator that generates an evanescent field, resulting in the restoration of high spatial frequency components to a far field radio frequency (RF) signal received at the antenna system;

a negative refractive index lens assembly that focuses the evanescent field onto a focal plane; and an RF detector assembly located in the focal plane, that detects the amplified evanescent field.

2. The system of claim 1, the evanescent field generator comprising a plate with a plurality of apertures arranged in a grid as to spatially sample the far field RF signal, where the diameter and effective path length of each of the plurality of apertures being selected to apply a desired complex gain to the far field RF signal at the aperture.

3. The system of claim 2, at least one of the plurality of apertures being filled with a dielectric material as to provide the selected effective path length at the at least one aperture.

4. The system of claim 1, the RF detector assembly comprising an array of fractional wavelength RF antennas to create a multiple-beam beamformer.

5. The system of claim 1, the negative refractive index lens assembly comprising:

a first array of planar lenses, aligned along a first direction as to focus the evanescent field into respective intermediate fields; and a second array of planar lens, aligned along a second direction as to focus the intermediate fields into a single focal point having a width less than a wavelength of the RF signal.

6. The system of claim 5, wherein each planar lens of the first and second arrays of planar lenses comprises a circuit board with at least one transmission line.

7. The system of claim 1, further comprising a signal preconditioning element that directs RF energy to the evanescent field generator.

8. A method for detecting a far field RF signal, comprising:

spatially filtering a far field RF signal to restore high spatial frequency components to the far field RF signal to produce an evanescent field;

focusing the evanescent field onto a focal plane; and detecting the focused evanescent field in the focal plane.

9. The method of claim 8, wherein focusing the evanescent field onto the focal plane comprises focusing the evanescent field at a negative refractive index lens.

10. The method of claim 8, wherein filtering a far field RF signal comprises directing the far field RF signal at a mask comprising a plurality of apertures, where the diameter and effective path length of each of the plurality of apertures is selected to apply a desired transfer function to the far field RF signal.

11. The method of claim 8, wherein focusing the evanescent field comprises focusing the evanescent field to an intermediate field along a transverse axis at a first lens assembly and focusing the intermediate field to a focal point in the focal plane at a second lens assembly.

* * * * *